US005651473A

United States Patent [19]

Preston et al.

[11] Patent Number: 5,651,473

[45] Date of Patent: Jul. 29, 1997

[54] SUPPORT SYSTEM FOR CRYOGENIC VESSELS

[75] Inventors: A. Duane Preston, New Prague; Timothy A. Neeser, Savage, both of Minn.

[73] Assignee: MVE, Inc., New Prague, Minn.

[21] Appl. No.: 974,950

[22] Filed: Nov. 12, 1992

[51] Int. Cl.[6] ..... F17C 13/00

[52] U.S. Cl. ..... 220/420; 220/421; 220/901

[58] Field of Search ..... 220/420, 421, 220/425, 469, 901

[56] References Cited

U.S. PATENT DOCUMENTS

| | | | |
|---|---|---|---|
| 3,119,238 | 1/1964 | Chamberlain et al. | 220/420 X |
| 3,341,215 | 9/1967 | Spector | 220/420 X |
| 3,698,200 | 10/1972 | Johnson et al. | 220/421 X |
| 3,705,498 | 12/1972 | De Haan | 220/421 X |
| 3,942,331 | 3/1976 | Newman, Jr. et al. | 220/421 X |
| 4,606,196 | 8/1986 | Acharya et al. | 220/421 X |

*Primary Examiner*—Steven M. Pollard
*Attorney, Agent, or Firm*—Rudnick & Wolfe

[57] ABSTRACT

The invention consists of an outer jacket surrounding and spaced from an inner tank to create an insulated space therebetween. The inner tank closely conforms to the outer jacket such that the insulation chamber is substantially uniform and the capacity of the inner tank is increased. An insulated support assembly that extends into the inner tank allows communication between the exterior of the vessel and the inner tank for pipes, pressure gauges and the like. The support assembly allows for a long insulated path without reducing the capacity of the tank to the same extent as the prior art devices.

6 Claims, 3 Drawing Sheets

SUPPORT SYSTEM FOR CRYOGENIC VESSELS

BACKGROUND OF THE INVENTION

The invention relates, generally, to storage vessels for cryogenic liquids and, more particularly, to an improved support system for such vessels.

The typical cryogenic storage vessel is shown in FIG. 1 and consists of an inner tank 3 for retaining a supply of cryogenic liquid. Surrounding the inner tank is an outer jacket 5. The outer jacket 5 is supported so as to be spaced from the inner tank thereby to create an insulation chamber 7 therebetween. The insulation chamber is filled with an insulating material, for example, sheets of super insulation wrapped around the inner tank, and a vacuum is created therein. The vacuum and insulating material minimize both radiant and conductive heat transfer to the interior of the inner tank, thereby to minimize vaporization of the cryogenic liquid stored therein.

As shown in FIG. 1, the typical tank includes a fill line 9 for delivering the cryogen to the tank, a delivery line 11 for delivering cryogen from the tank and a vent line 13. These lines run from the exterior of the vessel through the insulation chamber and into the tank. As will be apparent, these lines conduct heat from the external environment to the cryogen in tank 3. To minimize the inleak of heat to the tank, it is desirable to make the length of the pipes located in the insulating chamber 7 as long as possible thereby to make the heat path as long as possible. In the prior art this was accomplished by making the inner tank 3 relatively short as compared to the outer jacket 5 so as to create a wide insulation chamber in the area where the pipes penetrate the tank and jacket as shown at 17 and 19 in FIG. 1.

While such an arrangement minimizes the heat transferred through the pipes to the cryogen in the tank, it substantially reduces the capacity of the inner tank 3 as compared to the size of the outer jacket 5. It is also necessary to insulate the relatively larger area between the tank and jacket thereby increasing manufacturing costs. Moreover, because the lines exit the tank at various points on the jacket 5, extensive plumbing is required to connect these lines to the various valves, regulators and pipes for use.

Also illustrated in FIG. 1 is the prior art system for communicating a liquid level sensor with the liquid in the vessel. Typically, a pathway is created between the exterior of the vessel and the inner tank 3 by a conduit 21. A level sensor passes through conduit 21 to measure the level of the liquid cryogen. Conduit 21 creates a very short heat path between the inner tank 3 and external environment. As a result, significant, undesirable heat transfer occurs between external environment and the liquid cryogen in tank 3.

Thus, an improved support system for a cryogenic vessel is desired.

SUMMARY OF THE INVENTION

The present invention overcomes the above-noted shortcomings and consists of an outer jacket surrounding and spaced from an inner tank to create an insulated space therebetween. The inner tank closely conforms to the size and shape of the outer jacket such that the insulation chamber is substantially uniform and the capacity of the inner tank is increased. An insulated support assembly that extends into the inner tank allows communication with the interior of the tank for pipes, pressure gauges and the like. The support assembly allows for a long insulated path in communication with the inner tank without reducing the capacity of the tank to the same extent as the prior art devices.

DETAILED DESCRIPTION OF THE INVENTION

Figure 1:
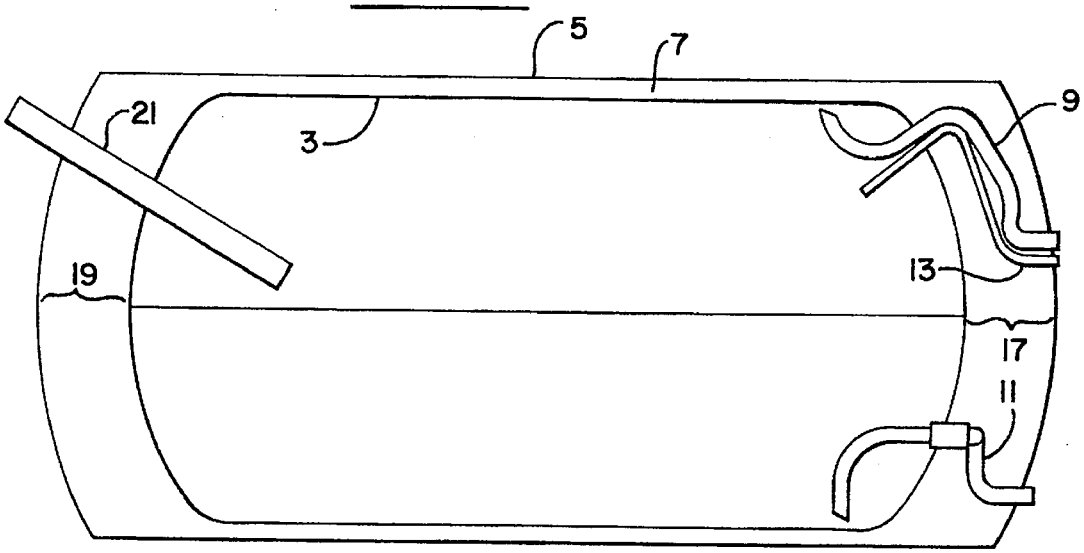
FIG. 1 PRIOR ART
FIG. 1 is a section view showing the support system of the prior art.
Figure 2:
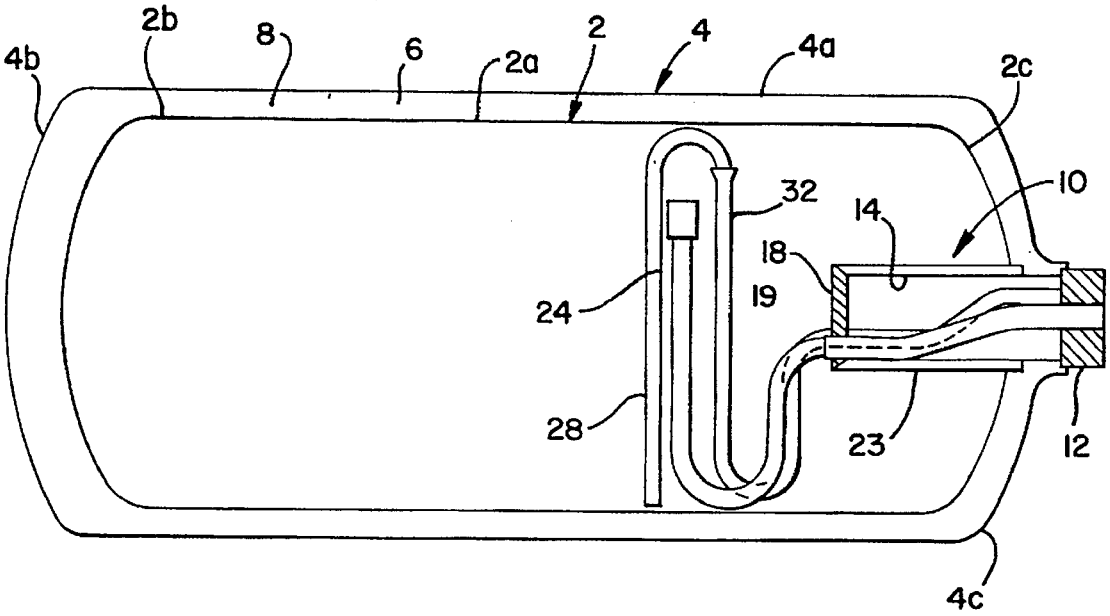
FIG. 2 is a section view showing the support system of the invention on an insulated vessel.
Figure 3:
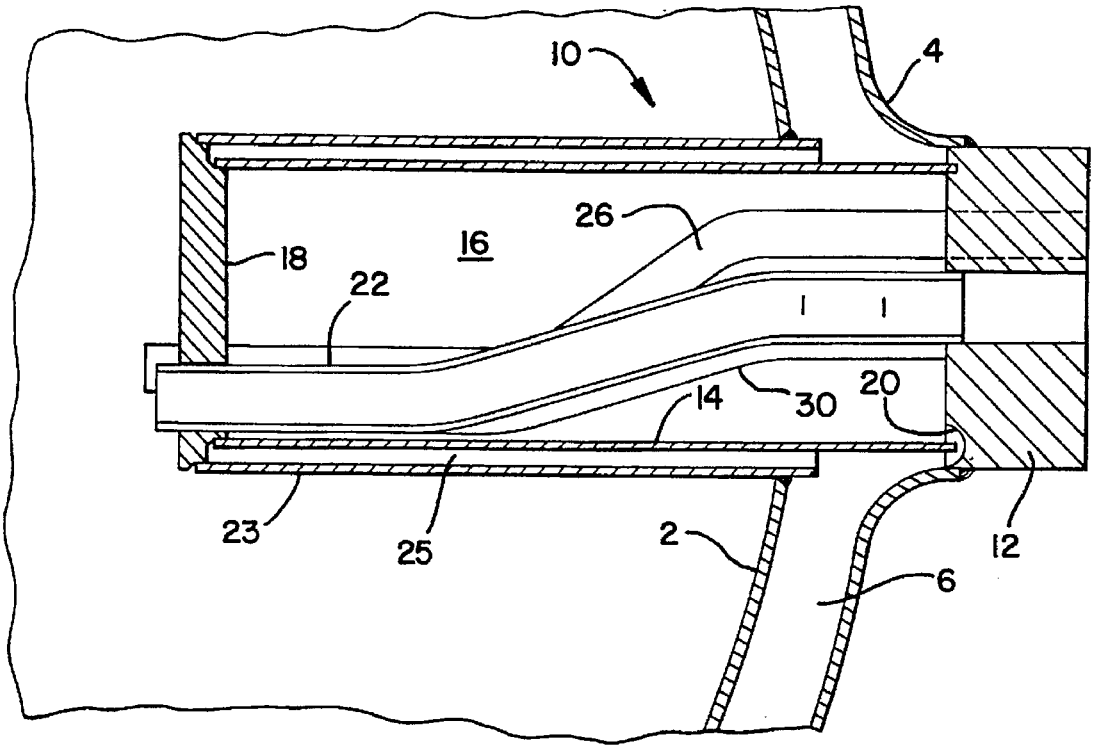
FIG. 3 is a more detailed section view of the support system of the invention.

Referring more particularly to FIGS. 2 and 3, the cryogenic storage vessel of the invention is shown generally at 1 consisting of an inner tank 2 for retaining a quantity of cryogenic liquid. Inner tank 2 consists of a cylindrical body 2*a* welded to heads 2*b* and 2*c*. Surrounding and spaced from the inner tank 2 is an outer jacket 4 such that an insulation chamber 6 is formed therebetween. Outer jacket 4 consists of a cylindrical body 4*a* welded to heads 4*b* and 4*c*. The insulation chamber 6 is filled with an insulating material 8 such as super insulation and a vacuum is created therein to minimize the heat transfer between the external environment and the interior of tank 2.

Mounted on one end of vessel 1 is a first embodiment of the support assembly of the invention 10, shown in greater detail in FIG. 3, for supporting the pipes that penetrate the vessel. Assembly 10 consists of a manifold block 12 that supports an inner cylindrical member 14. A collar 18 is fixed to the opposite end of member 14 to define interior space 16. A passageway 20 is provided in block 12 to communicate space 16 with insulation chamber 6 so that when a vacuum is created in insulation chamber 6 it will also be created in the space 16.

Collar 18 supports a second cylindrical member 23 that is disposed over and is coaxially aligned with member 14. The space 25 between the cylindrical members 14 and 23 also communicates with insulation chamber 6. Both spaces 16 and 25 may be filled with super insulation or the like.

A plurality of pipes extend between collar 18 and manifold block 12 such that when assembly 10 is installed on vessel 1 the pipes will allow communication between the interior and exterior of the vessel 1. Manifold block 12 is shown in detail in FIG. 4 and consists of through holes 12*a*, 12*b* and 12*c* which connect to the pipes 22, 26 and 30 to create a pathway from the exterior of the vessel to the interior of the vessel. As many or as few pipes can be used as dictated by the needs of the system. In the typical system, as shown in FIGS. 2 and 3, three pipes are provided. The first pipe 22 is connected to the liquid fill line 24, the second pipe 26 is connected to the liquid delivery line 28 and the third pipe 30 is connected to a vent 32. The pipes are provided with traps as will be appreciated by one skilled in the art to create a liquid/vapor interface therein.

When assembly 10 is installed in vessel 1, block 12 is welded or otherwise fixed to outer jacket 4 and cylindrical member 23 is welded or otherwise fixed to inner tank 2 to create liquid-tight seals therebetween as best shown in FIG.

3. When, during manufacture, chamber 6 is evacuated, spaces 16 and 25 will also be evacuated via passage 20 and the open end of member 23. Thus, support assembly 10 will provide the same thermal insulation as the remainder of the vessel.

Cylindrical member 23 is in contact with the inner tank 2 and the cryogenic fluid in inner tank 2. As a result, member 23 will be at the relatively cold temperature of the cryogenic liquid. Because member 23 does not extend to outer jacket 4, however, little or no heat loss will occur through this member. Conversely, cylindrical member 14, because it is separated from member 23 by insulated space 25, will not contact the relatively cold interior of the inner tank 2 such that any conductive heat transfer to member 14 will only occur through collar 18. As a result, the entire length of member 14 acts as a heat path thereby minimizing the heat transferred to the inner tank that would otherwise occur.

To assemble the vessel, support assembly 10 is welded to tank section 2*c* of the completed tank 2. Tank 2 is wrapped with super insulation or is otherwise insulated. The outer jacket sections 4*a*, 4*b* and 4*c* are placed over the insulated tank and welded in place including the welding of manifold block 12 to jacket section 4*c*. Chamber 6 is evacuated and the vessel is ready for use.

The support assembly of the invention 10 maintains the relatively long conductive path of pipes 22, 26 and 30, while maximizing the capacity of tank 2. Moreover, because the support assembly 10 is a unitary assembly, manufacture of the vessel is facilitated.

Figure 5:
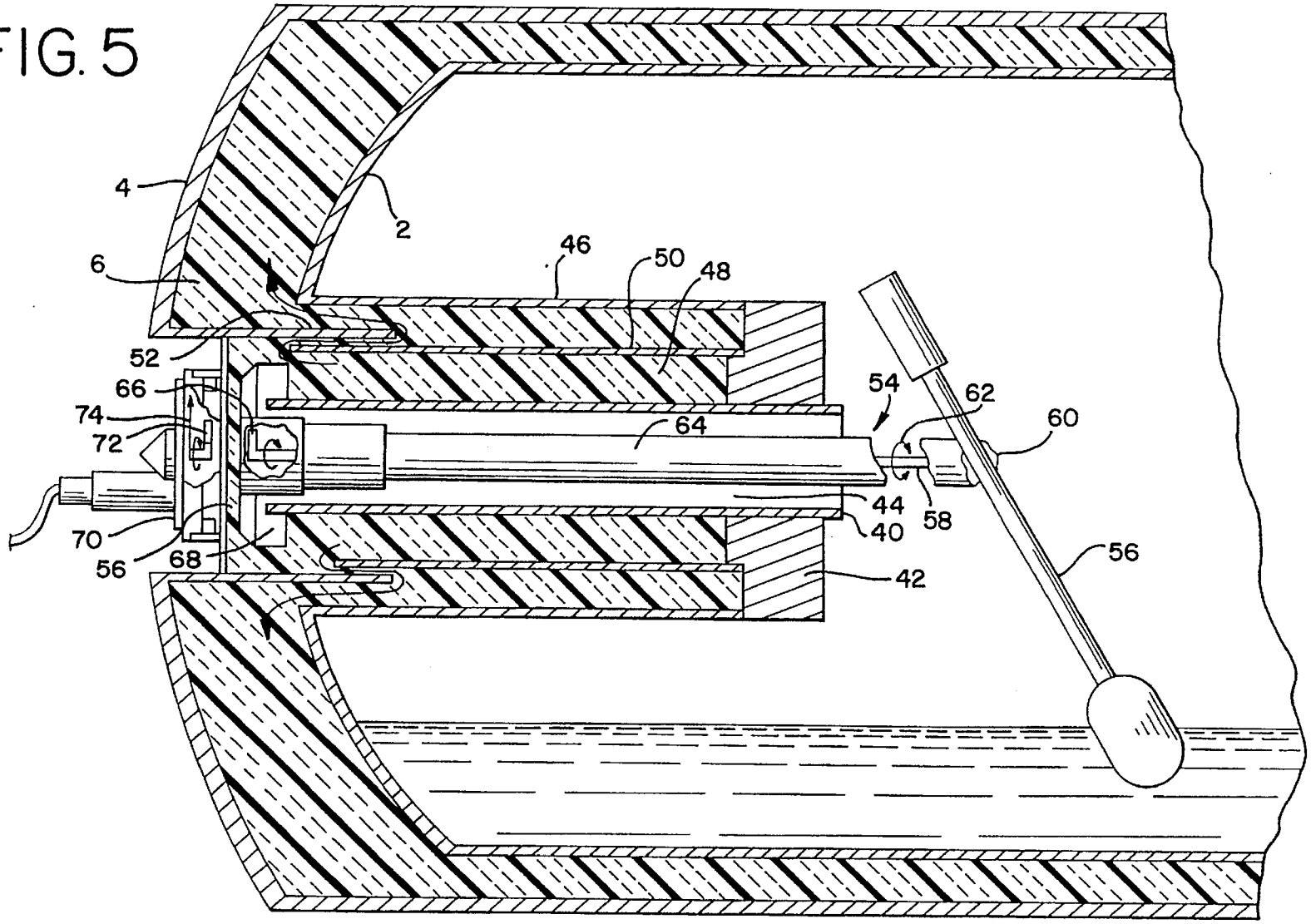
FIG. 5 is a detailed section view showing a further embodiment of the support system of the invention on an insulated vessel.

A further embodiment of the support system of the invention is shown in FIG. 5 mounted on a vessel having an inner tank 2, outer jacket 4 and insulation chamber 6 as previously described. This embodiment is designed specifically to accommodate the expansion and contraction of inner tank 2 that will occur due to the extremely cold temperatures associated with cryogenic liquids.

The support system includes a first cylindrical member 40 secured to and extending from collar 42 to define space 44. Collar 42 is supported in tank 2 by cylindrical member 46 that is secured to and extends from inner tank 2 to surround member 40 and create space 48. Located in space 48 and secured to collar 42 is member 50. Member 50 is dimensioned so as to be slidably received within guide member 52 that extends from the outer jacket 4 into space 48.

Figure 4:
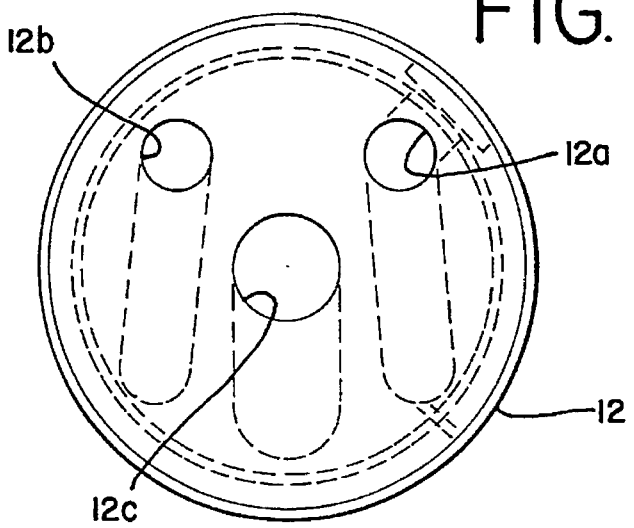
FIG. 4 is a side view of the manifold block of the invention.

Space 48 is vacuum insulated like insulation chamber 6. Specifically, when chamber 6 is evacuated, space 48 will also be evacuated along the path defined by the arrows in FIG. 5. Space 44 can be exposed to the inner tank 2 as shown in FIG. 4 to accommodate level sensor 54 or can be closed by collar 42 as was done in the embodiment of FIGS. 2 and 3 to accommodate the pipes. Space 44 retains the level sensor 54 or piping as described with reference to FIGS. 2 and 3. Where space 44 is in communication with the inner tank, as illustrated, an insulation layer 56 can be provided adjacent jacket 4 to minimize heat transfer. The level sensor 54 will transmit a signal indicative of the level of cryogenic liquid in tank 2 across the insulation layer 56 electronically, mechanically or magnetically.

Specifically, sensor 54 can include a float 56 mounted for pivotal motion responsive to the level of cryogenic fluid 20 in the storage vessel 10. The float is connected to shaft 58 by a bevel gear arrangement 60 such that shaft 58 will rotate as shown by arrows 62 as float 56 rises and falls due to changes in the level of the cryogen. The shaft 58 is mounted in and protected by a sleeve 64, which is secured within the support member 40. The distal end of the shaft 58 is secured to a first magnet 66, which rotates about the axis of shaft 58 responsive to the movement of the float 56. The first magnet 66 is enclosed in a housing 68.

A second housing 70 is mounted on the opposite side of the outer jacket 4. The second housing 70 contains a second magnet 72 rotatably mounted therein, which is mechanically connected to a needle indicator 74. The position of the needle indicator 74 may be observed through a transparent front plate. Significantly, housing 70 is spaced from housing 68 with insulation 56 disposed therebetween.

As will be apparent to one of ordinary skill in the art, the magnetic field generated by the first magnet 66 passes through the insulation layer 56 to signal the level of the cryogenic fluid via the second magnet 72, which moves with the first magnet 66. The insulation 56 breaks the mechanical communication between the first magnet 66 and the second magnet 72, preventing the accelerated transfer of heat between the cryogenic fluid and the external environment.

Additionally, the movement of the second magnet 72 may be used to vary the resistance across a potentiometer. The resistance of the potentiometer may be passed via a pair of wires to a remote gauge, where the level of the cryogenic fluid may be computed therefrom. Other methods of transferring a signal indicating the level of cryogenic fluid across insulation layer 56 may also be used.

In operation, the cold cryogenic liquid will cause the expansion and contraction of tank 2. This expansion and contraction is transmitted from tank 2 to members 40, 42, 46, and 50 and is accommodated as member 50 is free to move relative to member 52. This support also maintains a long heat path between the outer jacket 4 and the interior of tank 2 as was explained with reference to the embodiment of FIG. 2.

It should be noted that the supports of FIGS. 3 and 5 can be utilized on a single tank where the support of FIG. 3 is located at one end to retain the necessary piping and the support of FIG. 5 is located at the opposite end of the tank to accommodate expansion and contraction of the tank and support a level sensor or other similar device.

While the invention has been described in some detail with respect to the Figures, it will be appreciated that numerous changes in the details and construction can be made without departing from the spirit and scope of the invention as set forth in the appended claims.

What is claimed is:

1. An improved cryogenic liquid storage vessel, comprising:

(a) an inner tank for storing cryogenic liquid;

(b) an outer jacket surrounding the inner tank and defining an insulation space therebetween, said insulation space being evacuated;

(c) a first member defining an internal space, said first member having a first end connected to said outer jacket, the other end of said first member extending into said inner tank;

(d) a second member surrounding said first member, said second member having a first end connected to said inner tank and having an other and end thereof connected to said other end of said first member;

(e) means for communicating said internal space with said insulation space, whereby the internal space is evacuated with the insulation space; and (f) at least one pipe located in said space in communication with said inner tank and the exterior of said vessel.

2. The improved storage vessel of claim 1, wherein said insulation space is filed with an insulating medium and evacuated.

3. An improved cryogenic liquid storage vessel, comprising:

(a) an inner tank for storing cryogenic liquid;

(b) an outer jacket surrounding the inner tank to create an insulation space therebetween;

(c) a first member defining a first internal space, said first member having a first end connected to the inner tank, the other end of the first member extending into the inner tank;

(d) a second member located in said internal space and means for connecting the second member to the other end of said first member, said second member defining a second internal space located inside of the first internal space; and (e) a third member extending from said outer jacket into said first internal space, said third member being dimensioned to slidably receive said second member, said first and second internal spaces being in communication with one another and with said insulation space.

4. An enclosure for communicating the interior of a cryogenic tank to the exterior thereof, said tank including an inner vessel and an outer jacket defining an insulating space therebetween, the enclosure comprising:

(a) a pair of concentrically disposed elements defining an enclosed space 16, the outer element being spaced from the inner element to define an annular space therebetween, a first end of said pair being connected together internally of said inner vessel, the inner element being secured to the jacket, the outer element being secured to the inner vessel; and (b) means for connecting said annular space and said enclosed space 16 with said insulating space;

whereby piping and level sensing means and the like may communicate with the interior of the inner vessel while minimizing heat transfer.

5. An enclosure for communicating the interior of a cryogenic tank to the exterior thereof, said tank including an inner vessel and an outer jacket defining an insulating space therebetween, the enclosure comprising:

(a) a pair of concentrically disposed elements defining an enclosed space 16, the outer element being spaced from the inner element to define an annular space therebetween, a first end of said pair being connected together internally of said inner vessel, the inner element being slidably received by a third element secured to the jacket, the outer element being secured to the inner vessel; and (b) means for connecting said annular space and said enclosed space 16 with said insulating space;

whereby piping and level sensing means and the like may communicate with the interior of the inner vessel while minimizing heat transfer.

6. The improved storage vessel according to claim 1, further including a collar secured to said other ends of the first member and the second member.

* * * * *